US006418679B2

(12) United States Patent
Widmer

(10) Patent No.: US 6,418,679 B2
(45) **Date of Patent: *Jul. 16, 2002**

(54) SKYLIGHT CURB SEAL AND METHOD

(76) Inventor: Mark E. Widmer, 4213 Third St., Tillamook, OR (US) 97141

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/190,952

(22) Filed: Nov. 12, 1998

(51) Int. Cl.[7] ..... E04D 13/03; E04G 21/14; F16J 15/02

(52) U.S. Cl. ..... 52/200; 52/741.4; 52/745.16; 277/648; 277/630; 277/921

(58) Field of Search ..... 52/72, 200, 745.15, 52/745.16, 741.4, 741.1, 58; 277/631, 634, 648, 649, 921, 630, 637, 644; 29/897.3, 897.312

(56) References Cited

U.S. PATENT DOCUMENTS

| | | | | | |
|---|---|---|---|---|---|
| 2,703,060 | A | | 3/1955 | Kiefer | |
| 4,514,944 | A | | 5/1985 | Doell | |
| 4,527,368 | A | * | 7/1985 | Jentoft | 52/200 |
| 4,796,400 | A | | 1/1989 | Mulder | |
| 4,941,300 | A | | 7/1990 | Lyons, Jr. | |
| 4,972,638 | A | | 11/1990 | Minter | |
| 5,018,333 | A | | 5/1991 | Bruhm | |
| 5,046,292 | A | | 9/1991 | Sampson et al. | |
| 5,148,643 | A | * | 9/1992 | Sampson et al. | 52/200 |
| 5,199,234 | A | | 4/1993 | Guhl | |
| 5,355,644 | A | * | 10/1994 | Guhl et al. | 52/200 |
| 5,544,455 | A | * | 8/1996 | DeBlock | 52/200 |

* cited by examiner

*Primary Examiner*—Michael Safavi
(74) *Attorney, Agent, or Firm*—Birdwell, Janke & Durando, PLC

(57) ABSTRACT

An elongate gasket material for sealing a skylight to a curb has a substantially constant cross-sectional shape and dimensions along its length, and one or more compliant members extending therefrom to the skylight and curb. The compliant members are adapted to accommodate a predetermined range of spacings between the skylight and the curb. The compliant members are angled with respect to their points of contact with the skylight and the curb so that wind pressure applied to the compliant members increases the effectiveness of sealing.

23 Claims, 3 Drawing Sheets

SKYLIGHT CURB SEAL AND METHOD

BACKGROUND OF THE INVENTION

The present invention relates to a skylight curb seal and method, particularly for installing a skylight to a site-built curb wherein the dimensions of the curb and skylight are not required to be predetermined or matched to a high degree of tolerance.

Skylights continue to be popular features in new homes as well as popular additions to existing homes. They present some difficulties, however, particularly in sealing to the structure so as to prevent the entry of wind and moisture.

Skylights are typically attached to a curb, which is generally a wooden frame that is anchored to and extends upwardly from the roof of the structure. The curb is typically fabricated on-site by the roofing contractor. A seal between the skylight and the curb is typically formed with a caulking compound. Often the caulk dries, shrinks and hardens, and loses its compliance while at the same time detaching from the skylight and curb, so that it may lose much, if not all, of its effectiveness over time. Further, to avoid tolerancing problems between the typically onsite and hand-built curb and the manufactured skylight, the bead of caulk must be positioned on the top of the curb, rather than on its sides. As the sides of the curb are surrounded by metal flashing that does not extend to cover the top of the curb, the caulk so applied leaves space between the flashing and the caulking that is unprotected. This space is a source of leakage from moisture wicking or draining into the space between the flashing and the side of the curb.

As an alternative to caulk, a foam-backed tape is often employed which can eliminate the problem of hardening and shrinkage. However, the tape may not adhere well to the curb, or may lose its adhesion over time. Further, like caulk, foam-backed tape also fails to prevent access by wind and moisture to the side of the curb, and the space between the flashing and the side of the curb. Moreover, neither caulk nor tape can be effectively applied to a wet curb, hampering skylight installation in inclement weather.

As another alternative for sealing a skylight to a curb, a gasket is sometimes provided that includes compliant members for sealingly filling the space between an otherwise loosely fitting skylight and curb. For example, Guhl, U.S. Pat. No. 5,199,234, proposes a gasket resting on the curb having weatherstrip extensions that project upwardly against skylight frame that acts as a cover. This approach provides advantages over sealing with caulk; however, the gasket of Guhl also had disadvantages. For example, the gasket is formed as a complete, closed form unit, so it cannot be modified on-site to fit an existing curb. Therefore, the tolerance between the skylight and the curb must remain close, increasing costs and decreasing flexibility. Another disadvantage of the gasket of Guhl is that the utility of its weatherstrip extension depends on the pre-manufacture of a substantially parallel surface on the frame. Such "inward protrusions" are provided in some manufactured skylight/curb assemblies but are not typically provided in skylights designed for use with site-built curbs.

Accordingly, there is a need for a skylight curb seal and method that provides for sealing a variety of existing manufactured skylights of arbitrary nominal size to curbs that need not be matched to the size of the skylight to a close tolerance, to provide for increased sealing effectiveness and construction flexibility, and decreased cost.

SUMMARY OF THE INVENTION

A skylight curb seal according to the present invention solves the aforementioned problems and meets the aforementioned needs by providing an elongate gasket material having substantially constant cross-sectional shape and dimensions along its length. The gasket material has a substantially "L" shaped backbone portion with one or more compliant members extending therefrom. With reference to its position installed between a curb and a skylight placed over the curb, the backbone portion has a substantially horizontally extending leg, adapted for making contact with the top of the curb, and a substantially downwardly extending leg, adapted for disposition between the side of the curb, more particularly the side of flashing disposed adjacent the side of the curb, and the side of the skylight. The downwardly extending leg includes one or more downwardly depending compliant members. A first compliant member extends downwardly toward and comes into contact with the side of the skylight. A second compliant member extends downwardly toward and comes into contact with the flashing adjacent the side of the curb. The lengths of the compliant members are provided to permit the compliant members to accomodate a wide variation in the dimensions of the skylight with respect to the dimensions of the curb. As the compliant members are downwardly depending, wind acting against the compliant members forces-the compliant members against the curb and skylight surfaces with which they come into contact, increasing the effectiveness of sealing during windy conditions.

Therefore, it is a principal object of the present invention to provide a novel and improved skylight curb seal and method.

It is another object of the present invention to provide a skylight curb seal and method that provides for sealing a variety of different skylights on the construction site.

It is yet another object of the present invention to provide a skylight curb seal and method that provides for effectively sealing skylights having a variety of shapes and sizes.

It is still another object of the present invention to provide a skylight curb seal and method that provides for effectively sealing a skylight to a site-built curb that is not matched to the skylight with a close tolerance.

It is a further object of the present invention to provide a skylight curb seal and method that provides for increased construction flexibility and decreased cost.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
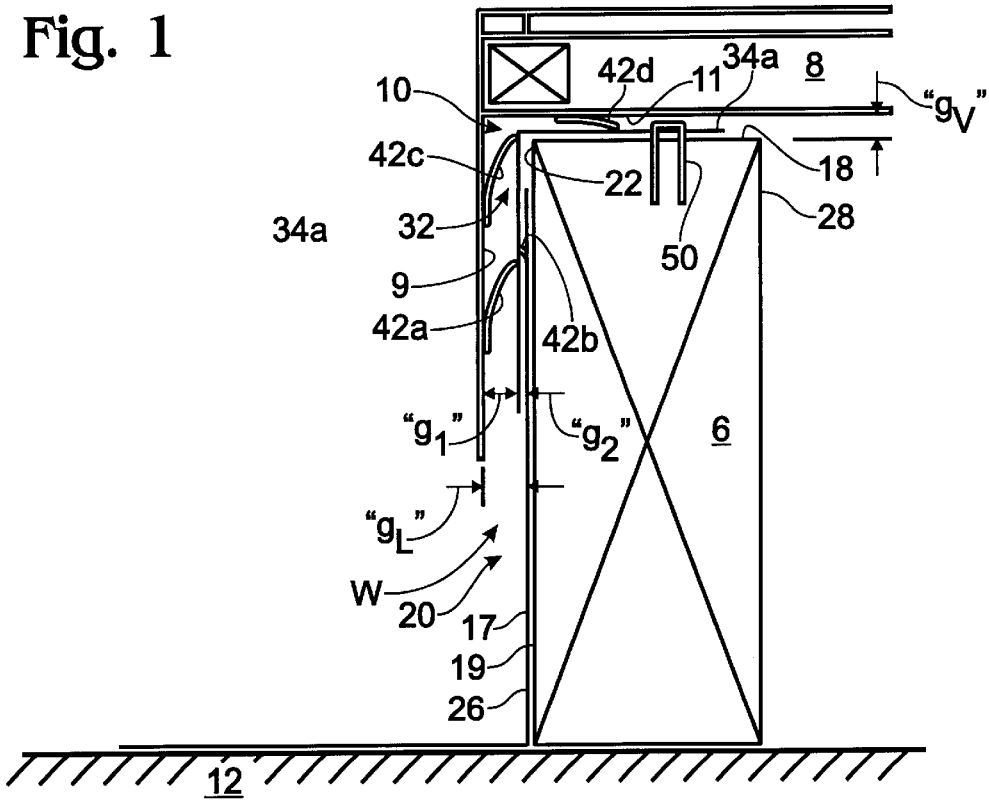
FIG. 1 is a cross-sectional view of a curb and skylight and seal for sealing therebetween according to the present invention.
Figure 2:
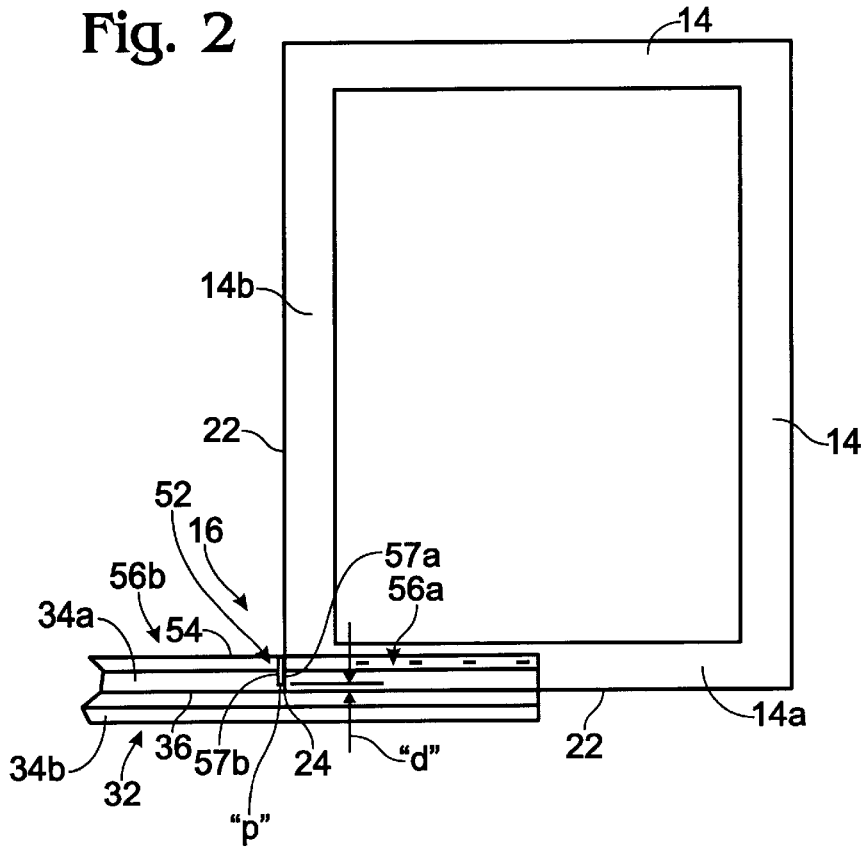
FIG. 2 is a plan view of the curb and seal of FIG. 1 and illustrates a first part of a method according to the present invention for sealing between the skylight and the curb.

Referring to FIG. 1, a curb 6, skylight 8 and seal 10 according to the present invention for sealing therebetween is shown in cross-section. In plan, the curb and skylight are typically rectangular in shape; however, the seal 10 may be employed for sealing skylights and curbs having arbitrary shapes. As aforementioned, the curb is mounted on the roof 12 of a structure and is typically fabricated at the construction site. Referring to FIG. 2 where the rectangular curb is shown in plan, the curb has four intersecting portions 14. Two of the portions 14*a* and 14*b* are employed herein to describe, below, a method for installing the seal 10. The two portions 14*a* and 14*b* join together to form a corner 16 of the curb 6.

Each of the portions 14 includes a top surface 18, an outer side surface 19, and an upper edge 22 which, taken over all of the portions, defines an outer perimeter of the curb. Where the portions 14*a* and 14*b* intersect, an upper corner 24 of the corner 16 is formed. Sheet metal flashing 26 is typically disposed adjacent the outer side surfaces 19 of the curb, extending from the roof and terminating just below the top surfaces 18. The flashing is not essential for practicing the invention; however, use of the flashing is assumed throughout the discussion below for illustrative purposes. More generally, associated outer side surfaces 20 are defined for purposes herein that represent either outer side surfaces 17 of the flashing, or the outer side surfaces 19 of the curb where the flashing is not provided.

The skylight 8 has inner side surfaces 9 that, when the skylight is installed on the curb 6, face respective outer side surfaces 20. The skylight also has an underside surface 11 that, when the skylight is installed on the curb, faces the top surfaces 18.

The skylight is typically a pre-manufactured assembly that may be purchased from a number of manufacturers. The curb is generally not precisely dimensioned to fit the skylight so that lateral gaps "$g_L$" exist between the skylight and an outer side surface 20 as shown in FIG. 1, that can vary substantially. Moreover, elevational gaps "$g_V$" exist between the skylight and the top surfaces 18 of the curb. As is particularly evident from FIG. 1, the gaps "$g_L$" and "$gV$" permit wind and moisture ("W") to reach the top surfaces 18, where the wind and moisture can reach interior portions 28 of the curb, while the gap "$g_L$" by itself permits the wind and moisture to enter between the flashing 26 and the outer side surfaces 19 of the curb.

The seal 10 is formed of a length of elongate gasket material 32 having a substantially constant cross-sectional shape and dimensions and which is cut to a length about equal to the circumference of the curb, i.e., the combined lengths of the upper edges 22. The material is preferably formed by extrusion and is formed of a flexible material, such as a natural or synthetic rubber, to provide for optimum sealing.

Figure 3:
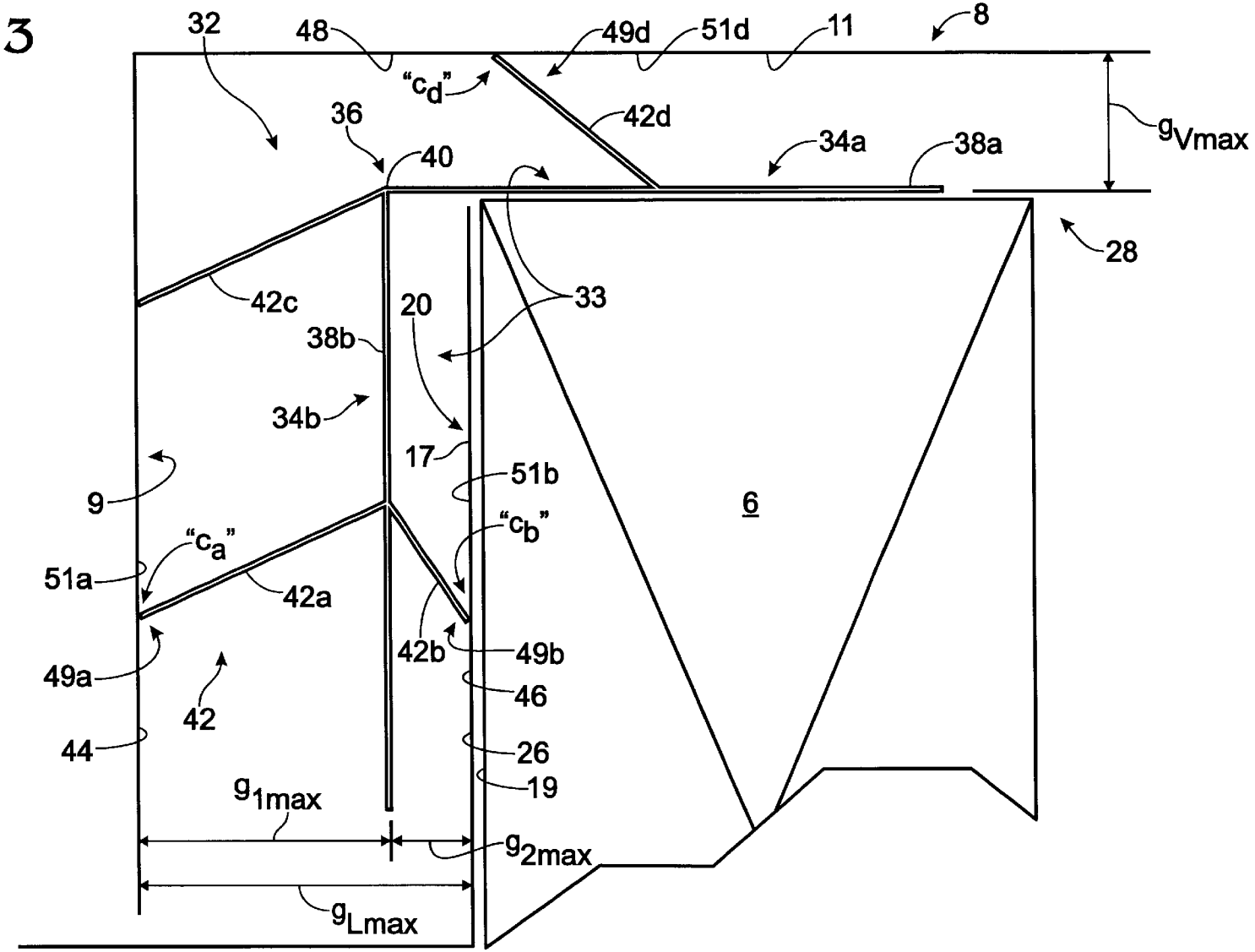
FIG. 3 is a cross-sectional view of sealing material of FIG. 1.

Particularly referring to FIG. 3, the gasket material 32 includes a backbone 33 comprising a top sheet 34*a* and a bottom sheet 34*b* that meet at a line 36 ofjoinder. The top sheet and bottom sheet are adapted to lie substantially parallel to the top surfaces 18 and the outer side surfaces 19, respectively, of the curb. Therefore, for the typical curb formed of square lumber, the sheets 34*a* and 34*b* are substantially perpendicular to one another. The angle between the sheets 34*a* and 34*b* is generally determined by the contour of the portions 14 of the curb and may differ from 90 degrees.

In the cross-section shown in FIG. 3, the sheets 34*a*, 34*b* appear as lines 38*a*, 38*b* and the line 36 appears as a point 40. For simplicity, the remaining features of the gasket material 32 will be described as they appear in cross-section, it being understood that what appears in cross-section as lines actually represents sheet-like surfaces.

The bottom sheet 34*b* includes one or more compliant members 42. While a number of compliant members 42 will be described, it will be understood that the invention does not require all or any particular combination of the compliant members. The compliant members generally fill in the space represented by the aforementioned gaps between the skylight and the curb, to seal against wind and moisture.

With reference to the orientation of the gasket material 32 as installed between the skylight 8 and the curb 6, a first compliant member 42*a* extends from the bottom sheet 34*b* toward the skylight 8. Particularly, the compliant member 42*a* extends so as to make a line of contact "$c_a$" with the inner side surface 9 of the skylight at an end 49*a* of the compliant member. The length of the compliant member 42*a* is determined so that contact is made with inner side surface of the skylight for a selected maximum size of the gap "$g_L$" between the skylight and the outer side surface 20 "$g_{Lmax}$"; more particularly, the gap "$g_{1max}$." The compliant member is preferably formed out of the flexible gasket material 32 and is therefore flexible. Because it is flexible, a length of the compliant member that is sufficient to bridge the gap "$g_{1max}$" is also effective, by bending of the compliant member, to bridge a smaller gap "$g_1$."

Along the line of contact "$c_a$", the first compliant member defines lower portions 44 of the inner side surface 9 that lie below the line of contact with respect to upper portions 51*a*. At least where the end 49*a* contacts the skylight, it forms an angle with respect to the lower portions 44 that is greater than 90 degrees, i.e., the first compliant member angles downwardly from the bottom sheet 34*b*. This geometry provides that, for wind pushing against the compliant member from the outside, the compliant member is pressed harder against the inner side surface 9, improving the seal.

A second compliant member 42*b* extends from the bottom sheet 34*b* toward the curb 6. The compliant member 42*b* extends so as to make a line of contact "$c_b$" with the outer side surface 20 at an end 49*b* of the second compliant member. Like the first compliant member, the length of the second compliant member is predetermined so that contact is made with the outer side surface 20 for a selected maximum size of the gap "$g_L$" between the skylight and the outer side surface 20 "$g_{Lmax}$"; more particularly, the gap "$g_{2max}$." Also like the first compliant member, the second compliant member is preferably formed out of the flexible gasket material 32 and is therefore flexible, for bridging a range of sizes of the gap "$g_2$."

Along the line of contact "$c_b$", the second compliant member defines lower portions 46 of the outer side surface 20 that lie below the line of contact with respect to upper portions 51*b*. At least where the end 49*b* contacts the outer side surface 20, it forms an angle with respect to the lower portions 46 that is greater than 90 degrees, i.e. like the first compliant member, the second compliant member angles downwardly from the bottom sheet 34*b*, for the same purpose.

A third compliant member 42*c* extends from the bottom sheet 34*b* toward the skylight 8. The third compliant member is constructed similarly to the first compliant member 42*a*, but is spaced above the first compliant member, preferably extending from the line of joinder 36.

A fourth compliant member 42*d* extends from the top sheet 34*a* toward the skylight 8. The compliant member 42*d* extends so as to make contact with the underside surface 11 of the skylight. The length of the compliant member 42*d* is predetermined for a selected maximum vertical "crush" or size of the gap "$g_V$" between the skylight and the curb "$g_{Vmax}$."

The compliant member 42*d* is also preferably formed out of the flexible gasket material 32 and is flexible. Preferably, the fourth compliant member 42*d* extends outwardly, away from the interior portions 28 of the curb, to function analagously with respect to entering wind and moisture as the first, second and third compliant members. That is, an end 49*d* of the fourth compliant member makes a line of contact "$c_d$" with the underside surface 11 of the skylight. Along the line of contact, the fourth compliant member defines outermost portions 48 of the underside surface with respect to innermost portions 51*d*, the outermost portions being adjacent the outer perimeter of the curb. At least where the end 49*d* contacts the skylight, it forms an angle with respect to the outermost portions 48 that is greater than 90 degrees.

Referring back to FIG. 1, because of the weatherproofing provided by the compliant members, the top sheet 34*a* may be pierced with fasteners 50, such as staples, for fastening it to the curb without danger of leakage. Preferably, such piercing is performed "downstream" of the compliant members with respect to the direction "W" of the wind and moisture. For example, where the four compliant members described above are all provided in the seal 10, the fasteners 50 are disposed on the top surfaces 18 of the curb, toward the interior portions 28 with respect to the fourth compliant member 42*d*.

Aside from its weatherproofing capabilities, an outstanding feature of the invention is that it provides a method for customizing the seal 10 at the job site, providing construction flexibility and economy. The method generally fits the gasket material 32 around the corner 16 of the curb 6. While a single, 90 degree corner is described for illustrative purpose, it will be immediately appreciated that the method applies to any number of corners forming arbitrary angles.

Referring back to FIG. 2, a linear cut 52 is made in the top sheet 34*a* substantially perpendicular to the elongate axis thereof. The cut extends from an outer edge 54 of the top sheet to a point "P" just short of the line 36 of joinder with the bottom sheet 34*b*. The top sheet is thereby separated into two flaps 56*a* and 56*b* that are "hinged" along the line of joinder substantially independently of one another. The cut 52 forms adjacent edges 57*a*, 57*b* of the flaps 56*a*, 56*b*, respectively, each being adjacent the upper corner 24.

Figure 4:
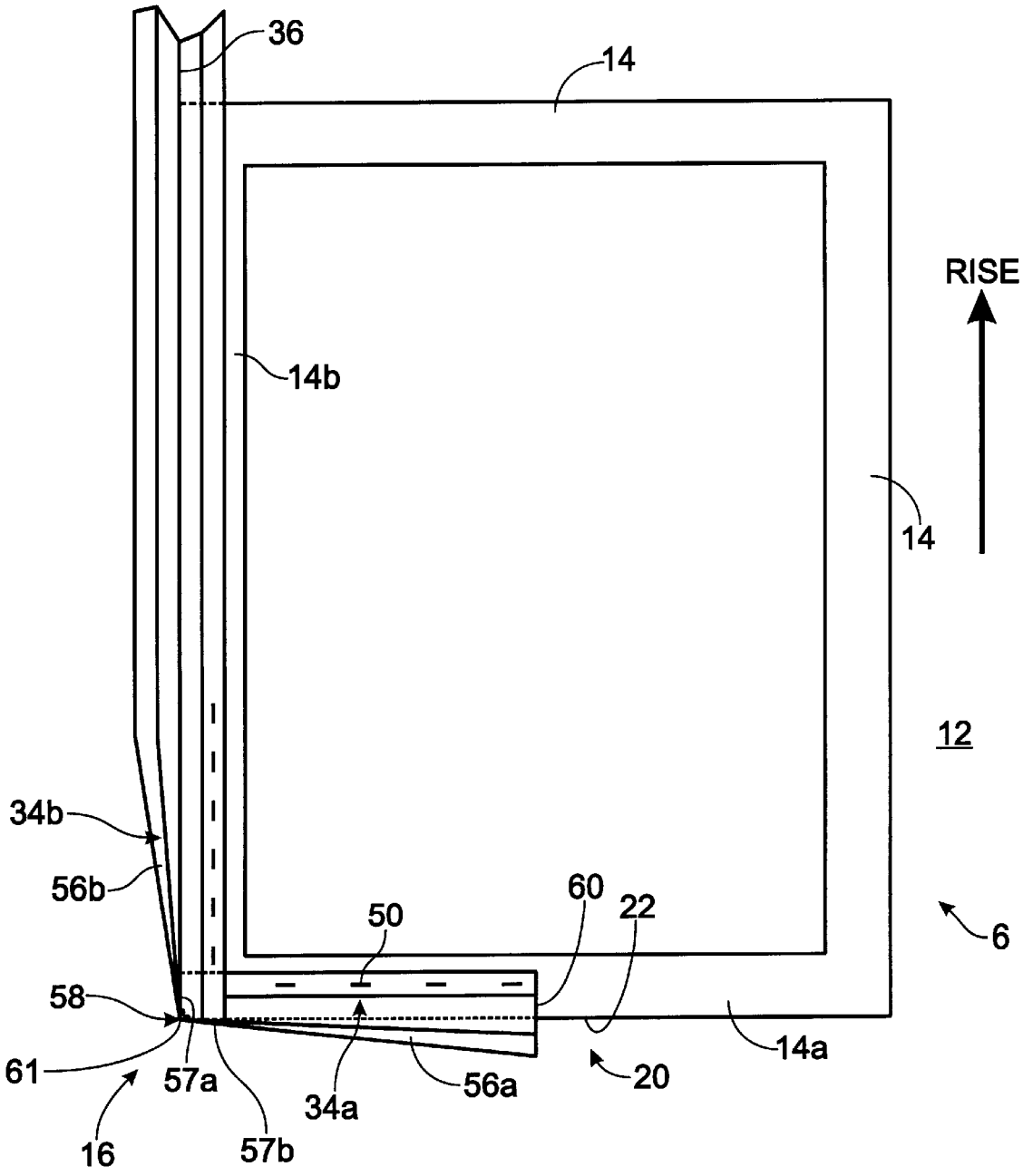
FIG. 4 is a plan view of the curb and seal of FIG. 2 and illustrates a second part of the method, the first part of which is illustrated in FIG. 2.

Referring to FIG. 4, the bottom sheet 34*b* is bent around the outer side surfaces 20 of the corner 16. This bending is permitted in the top sheet 34*a* by the cut 52, which allows the two flap portions 56*a* and 56*b* to come into an overlapping relation proximate the point "P" and the upper corner 24, partially sealing the upper corner.

As the gasket material 32 is bent around the corner of the curb, the line of joinder 36 is disposed along the upper edge 22 of the curb. In addition, the second compliant member 42*b*, where present, is pressed against the outer side surfaces 20 of both portions 14*a* and 14*b* of the curb.

Because the cut 52 stopped short of the line of joinder and because the gasket material is flexible, bending the gasket material around the outer side surfaces 20 produces a pucker 58 of the material at the point "P" of FIG. 2. The formation of the pucker 58 completes the sealing of the upper corner by eliminating the otherwise inevitable hole in the material at the tip 61 thereof that would occur if the cut 52 were not stopped short of the line of joinder as aforedescribed. Without the pucker 58, a leakage path would be provided at the upper corner 24.

The amount "d" of FIG. 2 that the cut 52 is stopped short of the line of joinder, and therefore the amount of the pucker 58, is determined primarily by the thickness of the gasket material 32. Typically, "d" is selected to be about two to three times this thickness.

The gasket material 32 may or may not be cut to length as aforedescribed before forming it around the corner 16. With the flap portions 56*a* and 56*b* of the top sheet 34*a* overlapping proximate the point "P" and the upper corner 24, they may be fastened to the top surfaces 18 of the curb. The flap portions may be fixed to the curb by fasteners 50 as aforedescribed, with an adhesive, or by any other desired method of attachment. Moreover, the seal 10 may also function adequately without attachment of the flap portions to the curb, wherein the pressure applied by the skylight is sufficient to hold the seal 10 in place.

As will be appreciated by those of ordinary skill in the art, ends 60 of the gasket material 32 as applied around the curb to form the seal 10 are preferably placed at the lowest point on the curb, to further discourage the entry of wind and moisture into the structure.

It is to be recognized that, while a specific curb seal and method has been shown and described as preferred, other configurations could be utilized, in addition to configurations already mentioned, without departing from the principles of the invention.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

I claim:

1. A skylight assembly for a roof, comprising:

a curb member adapted for attachment to the roof, said curb member having a top surface facing substantially upwardly with respect to a level line and an outer side surface;

a skylight member having an inner side surface substantially parallel to and spaced apart from said outer side surface of said curb member; and a seal member including a substantially planar bottom sheet of flexible material disposed between said inner side surface of said skylight member and said outer side surface of said curb member and spaced apart from said inner side surface of said skylight member a predetermined first gap distance, said bottom sheet including a first substantially planar compliant sheet member of said flexible material extending to meet said inner side surface of said skylight member in a downwardly direction with respect to the level line.

2. The skylight assembly of claim 1, further comprising a second substantially planar compliant sheet member of said flexible material extending from said bottom sheet to meet said inner side surface of said skylight member in a downwardly direction with respect to the level line.

3. The skylight assembly of claim 2, wherein said compliant members extend from said bottom sheet respective distances that substantially exceed said first gap distance, so that said compliant members are bent.

4. The skylight assembly of claim 3, wherein said compliant members are integrally formed with said bottom sheet.

5. The skylight assembly of claim 4, wherein said bottom sheet and said compliant members all have substantially the same thickness of said flexible material.

6. The skylight assembly of claim 1, wherein said skylight member includes an inner bottom surface, the assembly further comprising a substantially planar top sheet of said flexible material disposed between said top surface of said curb member and said inner bottom surface of said skylight member and meeting said bottom sheet at a line of joinder wherein said top and bottom sheets form an angle therebetween of substantially 90 degrees.

7. The skylight assembly of claim 6, wherein said top sheet is spaced apart from said inner bottom surface of said skylight a predetermined second gap distance and includes a second substantially planar compliant sheet member of said flexible material extending to meet said inner bottom surface, said second compliant member extending from said top sheet member a distance that substantially exceeds said second gap distance so that said second compliant member is bent.

8. The skylight assembly of claim 7, wherein said compliant member extending from said bottom sheet is integrally formed with said bottom sheet and said compliant member extending from said top sheet is integrally formed with said top sheet.

9. The skylight assembly of claim 8, wherein said top sheet, said bottom sheet and said compliant members all have substantially the same thickness of said flexible material.

10. The skylight assembly of claim 1, wherein said bottom sheet is spaced apart from said outer side surface of said curb member a predetermined second gap distance, and wherein said bottom sheet includes a second substantially planar compliant sheet member of said flexible material extending to meet said outer side surface of said curb member in a downwardly direction with respect to the level line.

11. The skylight assembly of claim 10, wherein said second compliant member extends from said bottom sheet a distance that substantially exceeds said second gap distance so that said second compliant member is bent.

12. The skylight assembly of claim 11, wherein said compliant member extending from said bottom sheet is integrally formed with said bottom sheet.

13. The skylight assembly of claim 12, wherein said bottom sheet and said compliant member all have substantially the same thickness of said flexible material.

14. The skylight assembly of claim 7, wherein said bottom sheet is spaced apart from said outer side surface of said curb member a predetermined third gap distance, and wherein said bottom sheet includes a third substantially planar compliant sheet member of said flexible material extending to meet said outer side surface of said curb member in a downwardly direction with respect to the level line.

15. The skylight of claim 14, wherein said third compliant member extends from said bottom sheet a distance that substantially exceeds said third gap distance so that said third compliant member is bent.

16. The skylight of claim 15, wherein said compliant members extending from said bottom sheet are integrally formed with said bottom sheet and said compliant member extending from said top sheet is integrally formed with said top sheet.

17. A seal for sealing between a skylight and a curb for a roof, comprising a substantially planar top sheet of a flexible material having a predetermined flexibility and a substantially planar bottom sheet of said flexible material meeting said top sheet at a line of joinder so that said top sheet extends in a first direction from said line of joinder and said bottom sheet extends in a second direction from said line of joinder perpendicular to said first direction, said bottom sheet including at least two spaced apart substantially planar compliant sheet members of said flexible material extending from said bottom sheet in a third direction having a first component directed perpendicular to said bottom sheet and opposite said first direction and a second component directed in said second direction, wherein said compliant members have a substantially uniform thickness dimension and a length dimension defining the distance said compliant members extend from said bottom sheet that is substantially equal for both compliant members and that is greater than said thickness dimension.

18. The seal of claim 17, wherein said compliant members are integrally formed with said bottom sheet and wherein said thickness dimension of said compliant members is substantially equal to a corresponding thickness dimension of said top and bottom sheets.

19. The seal of claim 18, wherein said top sheet, said bottom sheet and said compliant members all have substantially the same thickness of said flexible material.

20. The seal of claim 19, wherein said top and bottom sheets form an angle therebetween of substantially 90 degrees.

21. A method for forming a seal for sealing a skylight to a curb, the curb including two adjoining portions forming a corner, each portion having a top surface, an associated outer side surface and an upper edge, the upper edges of the two portions meeting at an upper corner of the curb, the seal comprising a length of an elongate flexible sealing material including a first sheet and a second sheet joined along a line of joinder to said first sheet and extending to respective edges, the first and second sheets forming an angle with respect to one another, the method comprising:

cutting the first sheet of the sealing material along a cut line extending from the edge thereof to a point that is short of the line of joinder a predetermined amount to form adjacent portions of the first sheet that are substantially independently bendable about the line of joinder;

positioning said point immediately adjacent the upper corner;

positioning the line of joinder along the upper edge;

positioning the second sheet along the outer side surface associated with one of the portions of the curb;

bending the second sheet around the corner of the curb so as to position the second sheet adjacent the outer side surface associated with the other of the portions of the curb; and bending said adjacent portions of the first sheet with respect to one another along the line of joinder to allow said adjacent portions to assume an overlapping relationship proximate the upper corner of the curb, for partial sealing of the upper corner, said bending producing a pucker at said point for completing the sealing of the upper corner.

22. The method of claim 21, including fastening said adjacent portions of said first sheet to the top surfaces of the corresponding portions of the curb.

23. The method of claim 22, wherein said fastening includes piercing at least one of said portions of said first sheet with a fastener.

* * * * *